US011248882B2

(12) United States Patent
Howell

(10) Patent No.: US 11,248,882 B2
(45) Date of Patent: Feb. 15, 2022

(54) DUELING TARGET SHOOTING ASSEMBLY

(71) Applicant: Dick's Sporting Goods, Inc., Coraopolis, PA (US)

(72) Inventor: Jacob Ray Howell, Kent, OH (US)

(73) Assignee: Dick's Sporting Goods, Inc., Coraopolis, PA (US)

( * ) Notice: Subject to any disclaimer, the term of this patent is extended or adjusted under 35 U.S.C. 154(b) by 4 days.

(21) Appl. No.: 16/590,823

(22) Filed: Oct. 2, 2019

(65) Prior Publication Data

US 2021/0102787 A1 Apr. 8, 2021

(51) Int. Cl.
*F41J 9/02* (2006.01)
*F41J 9/16* (2006.01)

(52) U.S. Cl.
CPC ... *F41J 9/02* (2013.01); *F41J 9/16* (2013.01)

(58) Field of Classification Search
CPC . F41J 1/00; F41J 1/10; F41J 7/00; F41J 7/04; F41J 9/00; F41J 9/16
See application file for complete search history.

(56) References Cited

U.S. PATENT DOCUMENTS 402,112 A * 4/1889 Sterick ..... A63F 9/0204 273/393
434,522 A * 8/1890 Pederson ..... F41J 7/04 273/390
1,348,540 A * 8/1920 Briggs ..... F41J 7/04 273/388
1,424,632 A * 8/1922 Fenton ..... F41J 7/04 273/392
1,507,296 A * 9/1924 Newman ..... A63F 9/02 273/369
1,540,802 A * 6/1925 Ordway ..... A63F 9/0243 273/368
1,616,270 A 2/1927 Madden
2,272,597 A * 2/1942 Butler ..... F41J 9/02 463/56

(Continued)

FOREIGN PATENT DOCUMENTS

CN 105135951 A 12/2015
WO WO-2008143585 A1 * 11/2008 ..... F41J 7/04

OTHER PUBLICATIONS

Information about Related Patents and Patent Applications, see section 6 of the accompanying Information Disclosure Statement Letter, which concerns Related Patents and Patent Applications.

(Continued)

*Primary Examiner* — Melba Bumgarner
*Assistant Examiner* — Amir A Klayman
(74) *Attorney, Agent, or Firm* — Fox Rothschild LLP

(57) ABSTRACT

A shooting target assembly includes a balance bar having a center portion that is rotatably connected to a support, a first target assembly rotatably connected to a first end of the balance bar at a first pivot point, and a second target assembly rotatably connected to a second end of the balance bar at a second pivot point. The first target assembly includes a plurality of first target zones, the second target assembly includes a plurality of second target zones, each of the first target zones and each of the second target zones is configured to engage one or more targets, and the balance bar is configured to rotate about the center portion in response to one or more of the targets being broken.

9 Claims, 10 Drawing Sheets

(56) References Cited

U.S. PATENT DOCUMENTS 2,325,593 A * 7/1943 Delamere ..... F41J 9/02 273/367
2,551,720 A * 5/1951 Bevis ..... A63F 9/26 273/390
2,967,712 A * 1/1961 Breitenfeldt ..... F41J 7/04 273/388
3,118,670 A * 1/1964 Smith ..... A63B 69/0091 473/429
3,424,455 A * 1/1969 Dunson ..... A63F 9/26 273/459
3,472,075 A * 10/1969 Oppenheimer ..... A63B 57/40 473/145
3,552,749 A * 1/1971 Piggotte ..... A63B 69/0071 473/448
3,744,792 A * 7/1973 McClary ..... A63F 9/26 273/459
3,774,908 A * 11/1973 Greenberg ..... A63F 9/26 273/459
3,817,526 A * 6/1974 Bibb ..... A63F 9/26 273/390
3,866,916 A * 2/1975 Clarke ..... A63F 9/0243 273/338
D257,779 S 1/1981 Sippola
4,245,843 A * 1/1981 Griggs ..... A63B 63/00 273/380
4,283,060 A * 8/1981 Braunschweiler ..... F41J 7/00 273/383
D288,828 S 3/1987 Romestan et al.
5,176,386 A * 1/1993 Simmons ..... F41J 7/04 273/392
5,263,721 A * 11/1993 Lowrance ..... F41J 7/04 273/383
5,263,722 A 11/1993 Rosellen
5,324,043 A 6/1994 Estrella
5,467,979 A * 11/1995 Zarate ..... A63B 69/0091 473/429
5,795,251 A * 8/1998 Andersen ..... A63B 69/0091 473/427
5,833,555 A * 11/1998 Jer-Min ..... A63B 69/0091 473/429
6,398,215 B1 6/2002 Carroll
6,896,267 B1 5/2005 Le Anna
6,983,938 B2 1/2006 Goldsmith
6,994,349 B2 2/2006 Lambert et al.
6,994,398 B2 2/2006 Gross
7,114,725 B2 10/2006 Camp et al.
7,134,977 B2 * 11/2006 Campbell ..... A63B 63/06 473/454
7,297,092 B1 * 11/2007 Gaynor ..... A63B 69/004 482/86
7,306,229 B2 12/2007 Rolfe
7,338,048 B1 * 3/2008 Hulstine ..... F41J 1/10 211/196
7,611,147 B2 11/2009 Sheldon
7,690,656 B2 4/2010 Saunders
7,731,197 B2 6/2010 Stutz
7,988,155 B2 8/2011 Wyrick et al.
8,172,231 B2 5/2012 Massier
D689,164 S 9/2013 Burress
8,807,570 B1 8/2014 Zalar
9,163,912 B1 * 10/2015 Stark ..... F41J 1/10
9,228,809 B1 * 1/2016 Relyea ..... F41J 9/02
9,303,959 B2 4/2016 Doria
9,446,301 B2 9/2016 Leimberer
9,513,091 B2 12/2016 Roberts
9,574,855 B2 2/2017 Davis
D787,009 S 5/2017 Carpenter
9,702,667 B1 * 7/2017 Gutierrez ..... F41J 9/02
D815,241 S 4/2018 Woller
10,119,795 B2 11/2018 Daub et al.
10,215,541 B2 * 2/2019 Nicholson ..... F41J 1/10
10,273,340 B2 * 4/2019 Hopkins, Jr. ..... C08J 3/096
10,487,979 B2 * 11/2019 Simons ..... E04H 12/00
10,488,160 B2 * 11/2019 La Scola ..... F41J 1/10
10,502,535 B2 * 12/2019 Sun ..... F41J 7/04
D878,469 S 3/2020 Kinner
10,589,157 B2 * 3/2020 Kinner ..... A63G 31/007
D903,811 S 12/2020 Engler et al.
10,955,225 B2 * 3/2021 Dunstan ..... F41J 7/04
D917,653 S * 4/2021 Howell ..... D22/113
D917,654 S * 4/2021 Howell ..... D22/113
2007/0013138 A1 * 1/2007 Hinnant ..... F41J 1/10 273/407
2007/0167297 A1 * 7/2007 Stevenson ..... A63B 69/004 482/83
2011/0163503 A1 * 7/2011 Townsend ..... F41J 5/18 273/355
2015/0069709 A1 3/2015 Doria
2015/0285593 A1 10/2015 Dribben
2016/0213989 A1 7/2016 Fristaczki
2019/0360785 A1 * 11/2019 Bitkowski ..... F41J 7/04

OTHER PUBLICATIONS

"Do-All Outdoors—Heli Handgun Spinner Steel Target, Rated for .038-.45 Caliber" [online], Do-All Outdoors, [Product first available on Feb. 1, 2014], https://www.amazon.com/dp/B0016LC44A/.

"Do-All Outdoors—Bonehead Rebar Triple Spinner Steel Target, Rated for .22 Caliber," [online], Do-All Outdoors, [Product first available on Mar. 31, 2015], https://www.amazon.com/dp/B00TYUXUZO.

"Do-All Outdoors—Auto Reset Pro-Style Steel Target, Rated for .22 Caliuber," [online], Do-All Outdoors, [Product first available on Feb. 17, 2015], https:www.amazon.com/dp/B00N23USF4/.

* cited by examiner

DUELING TARGET SHOOTING ASSEMBLY

BACKGROUND

The disclosure relates generally to firearm targets, and in particular to target shooting assemblies.

Target shooting assemblies are tools used to test the skills of a marksman, such as a dart thrower, an archer, or a firearm shooter, for example by throwing or shooting a projectile (i.e., a dart, arrow, bullet, or the like) against a target surface. A target shooting assembly may be used to assist novice firearm shooters with weapon familiarization, for recreational target practice, and for sport shooting competitions (such as clay target shooting, rapid fire shooting, running target shooting at either moving targets or disappearing targets, bullseye shooting, field shooting, or the like). Firearm enthusiasts (e.g., shooters) shoot firearm projectiles (e.g., ammunition) at target shooting assemblies to test their proficiency of precision (i.e., repeatedly placing a three-round shoot group in a small area not necessarily at the center of the target), accuracy (i.e., placing a single round nearest the center of a target), and speed (i.e., breath control, trigger squeeze control, magazine reload skills, or the like).

Target shooting assemblies generally have a stable base frame, a supporting target frame extending upward from the base frame, and at least one target supported by the target frame. The base frame is stable enough to withstand rotational moment forces generated by a projectile striking either the target or the support frame. The support frame is sturdy enough to withstand errant projectiles striking the fame members. The target can be a steel plate, a bursting target, a paper target sheet, a cardboard target, a wood board target, a plastic sheet target, or the like.

The sport of stationary steel plate target shooting has evolved into shooting at moving plates, swinging plates, spinning plates, pivoting plates, and even target systems having an additional target plate shot at to reset the main set of movable target plates.

The sport of target dueling involves two competitors (i.e., pistol shooters) shooting multiple metal plate targets on their respective side of a 'dueling tree'. If a target is hit, it rotates around the dueling tree to the opponent's side of the tree. The first shooter to hit all targets over to the opponent's side before either all ammunition is exhausted or time runs out wins the duel.

The majority of target dueling involves targets that remain at common elevations. To improve the challenge of the common dueling target shooting assembly, there is a desire to increase the difficulty of the target dueling. A dueling target shooting assembly with two pivotable target faceplates used in combination with targets that, when shot, causes a portion of the dueling target shooting assembly to spin adds an increased level of difficulty.

SUMMARY

In an embodiment, a shooting target assembly includes a balance bar having a center portion that is rotatably connected to a support, a first target assembly rotatably connected to a first end of the balance bar at a first pivot point, and a second target assembly rotatably connected to a second end of the balance bar at a second pivot point. The first target assembly includes a plurality of first target zones, the second target assembly includes a plurality of second target zones, each of the first target zones and each of the second target zones is configured to engage one or more targets, and the balance bar is configured to rotate about the center portion in response to one or more of the targets being broken.

The balance bar may be configured to rotate in a first direction in response to one or more of the targets of the first target assembly being broken. The balance bar may be configured to rotate in a second direction in response to one or more of the targets of the second target assembly being broken.

The first target assembly may be configured to rotate about the first pivot point in response to one or more of the targets of the first target assembly being broken.

The second target assembly may be configured to rotate about the second pivot point in response to one or more of the targets of the second target assembly being broken.

In an embodiment, a dueling target assembly includes a balance bar pivotable about a central pivot point, a first target faceplates, a second target faceplates, a first target holder extending from the first target faceplate and configured to hold a first target adjacent to the first target faceplate, and a second target holder extending from the second target faceplate and configured to hold a second target adjacent to the second target faceplate. The balance bar includes two faceplate pivot points evenly spaced from the central pivot point. Each of the target faceplates is pivotable about one of the two faceplate pivot points, each of the target faceplates is configured to engage one or more targets, and each of the target faceplates is configured to rotate about its corresponding faceplate pivot point when one or more of the targets engaged by the target faceplate is removed from the target faceplate.

Each target faceplate may include a plurality of target holders. The dueling target assembly may include at least four targets.

In an embodiment, a dueling target assembly includes a balance bar having a central portion including a central pivot aperture, and two end portions, each end portion including a faceplate pivot support, and two target faceplate assemblies. Each target faceplate assembly includes a faceplate having at least two target apertures, a target holder configured to hold a target over one or more target apertures, and two faceplate pivot assemblies supported in each faceplate pivot support. Each target faceplate assembly is pivotable about the faceplate pivot assembly. A center of mass of the dueling target assembly is aligned with the central pivot aperture when all target apertures are covered by targets, and the center of mass of the dueling target assembly is offset with the central pivot aperture when at least one of the targets is removed from either of the two target faceplate assemblies.

The balance bar may be pivotable about the central pivot aperture. The faceplate may include a faceplate pivot aperture, and at least one target holder aperture adjacent each target aperture.

A center of mass of the target faceplate assembly may be aligned with the faceplate pivot aperture when all target apertures are covered by targets. The center of mass of the target faceplate assembly may be offset with the faceplate pivot aperture when at least one of the targets is removed from either of the two target faceplate assemblies.

Each target holder may extend from one of the target holder apertures. Each target faceplate assembly may include a plurality of target holders adjacent each target aperture.

The dueling target assembly may include at least four targets that each cover one target aperture. The dueling target assembly may include a base assembly having a base support, and a balance bar pivot support. The dueling target assembly may include a balance bar pivot assembly having a balance bar pivot assembly rotation axis where the balance bar pivot assembly rotation axis may be configured to align with the central pivot aperture of the balance bar and the balance bar pivot support of the base assembly. The base support may include at least one ground stake, an L-shaped base bracket, and a U-shaped base bracket.

The balance bar pivot support may include a pivot collar and at least one bearing. The at least one bearing is adjacent the pivot collar, and the dueling target assembly is pivotally coupled to the pivot collar. The balance bar pivot assembly may include a pivot pin and a pivot fastener. The balance bar pivot assembly may include a resilient member.

DETAILED DESCRIPTION

As used in this document, the singular forms "a," "an," and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to." When used in this document, the term "exemplary" is intended to mean "by way of example" and is not intended to indicate that a particular exemplary item is preferred or required.

In this document, when terms such "first" and "second" are used to modify a noun, such use is simply intended to distinguish one item from another, and is not intended to require a sequential order unless specifically stated. The term "approximately," when used in connection with a numeric value, is intended to include values that are close to, but not exactly, the number. For example, in some embodiments, the term "approximately" may include values that are within +/−10 percent of the value.

When used in this document, terms such as "top" and "bottom," "upper" and "lower", or "front" and "rear," are not intended to have absolute orientations but are instead intended to describe relative positions of various components with respect to each other. For example, a first component may be an "upper" component and a second component may be a "lower" component when a device of which the components are a part is oriented in a first direction. The relative orientations of the components may be reversed, or the components may be on the same plane, if the orientation of the structure that contains the components is changed. The claims are intended to include all orientations of a device containing such components.

Figure 1:
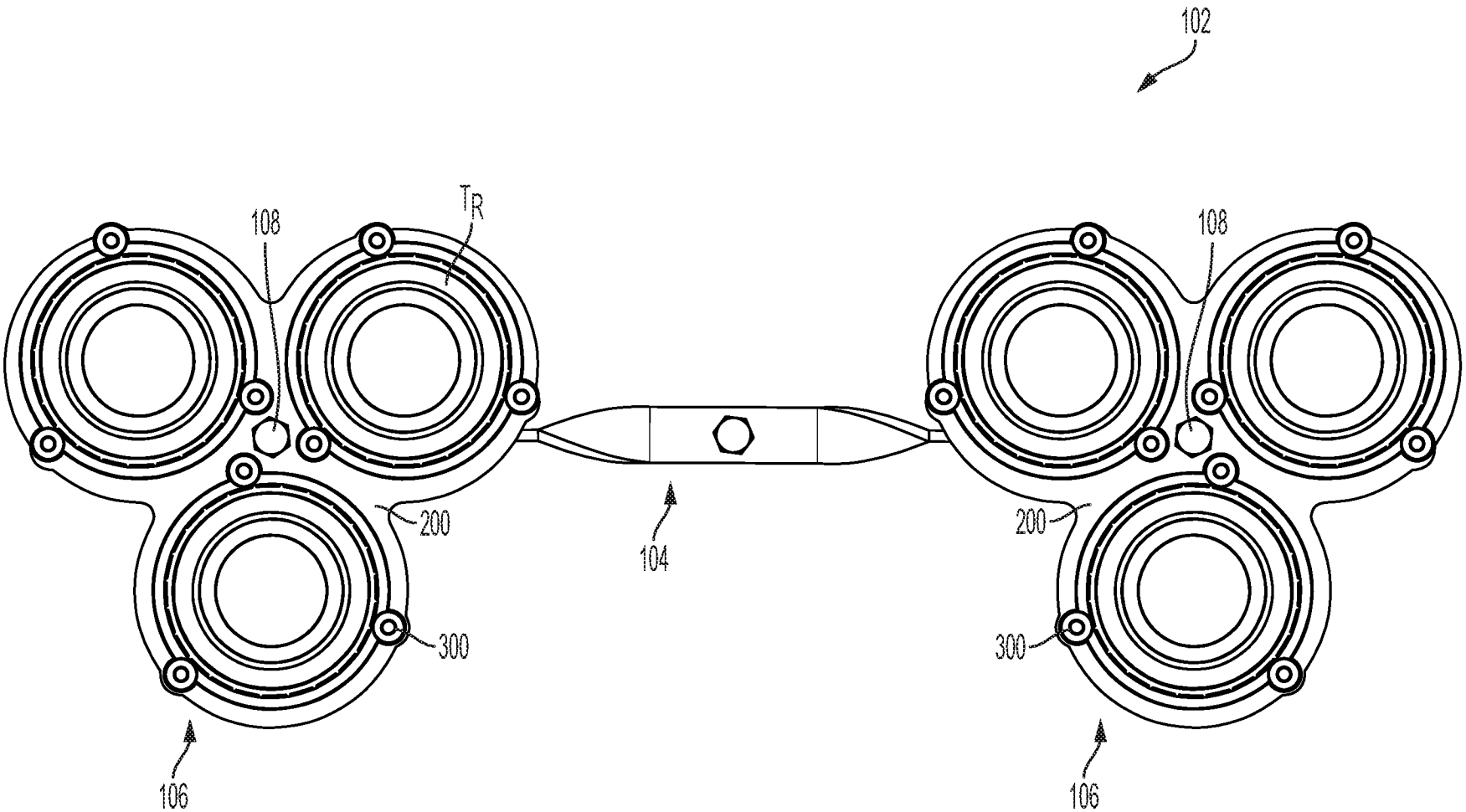
FIG. 1 illustrates an expanded view of an example dueling target assembly.

As seen in FIG. 1, a dueling target assembly 102 may include a balance bar 104, two target faceplate assemblies 106, two faceplate pivot assemblies 108, and one or more targets T, all of which will be described in more detail below. The dueling target assembly 102 may be pivotally mounted to a support (such as, for example, a post, a pole, or a tree), suspended from a support, or attached to a movable base assembly 502, as will be described in more detail below.

In an embodiment, a target may be any suitable type of target for shooting. For example, a target may be a reactive target, a clay pigeon, a replaceable target, a removable target, a re-sealable target, a self-healing target, and/or the like.

Figure 2A:
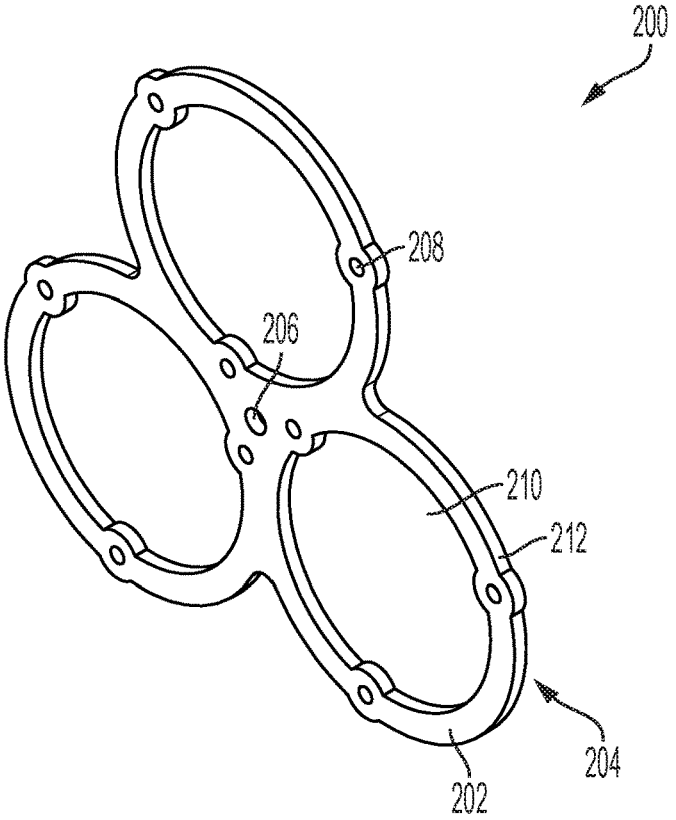
FIG. 2A illustrates an isomeric view of an example faceplate.

Each of the two target faceplate assemblies 106 may include a faceplate 200 and at least one target holder 300. FIG. 2A illustrates a view of an example faceplate 200 according to an embodiment. The faceplate 200 may include a front surface 202, a rear surface 204, a central pivot 206, and at least one target holder portion 208. The central pivot 206 may be an aperture. Alternatively, the central pivot 206 may be a rearward extending post or the like. The target holder portion 208 may be an aperture. Alternatively the target holder portion 208 may be a forward extending post or the like.

Figure 2B:
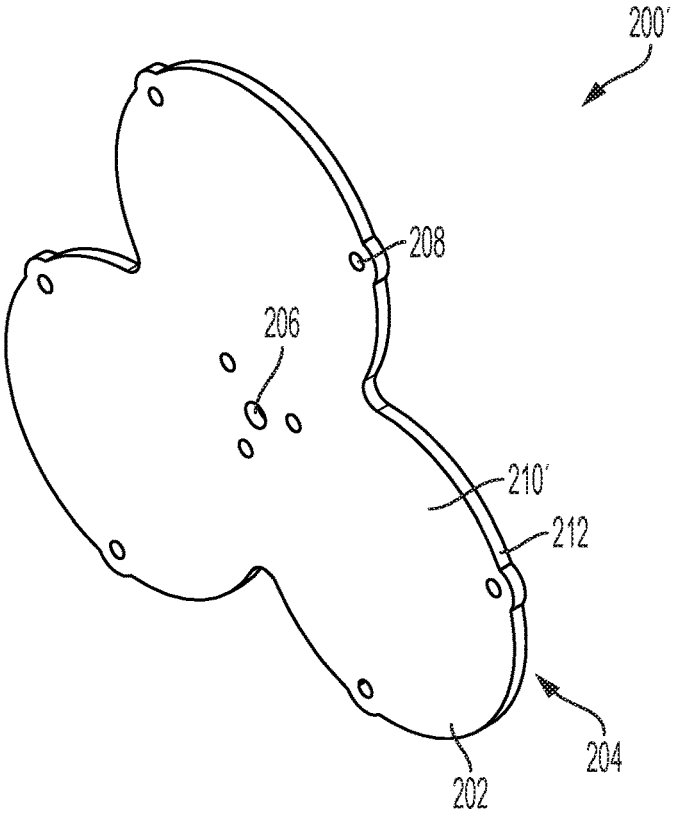
FIG. 2B illustrates an isomeric view of another example faceplate.

The faceplate 200 may include one or more target apertures 210 spaced around the central pivot 206, such that at least one target holder portion 208 may be adjacent each target aperture 210. The central pivot 206, target holder apertures 208, and/or target apertures 210 may be openings that extend from the front surface 202 to the rear surface 204 of the faceplate 200. FIG. 2B illustrates an isomeric view of another example faceplate 200' according to a second embodiment. The faceplate 200' may be a substantially planar sheet having a plurality of target zones 210' spaced evenly around a central pivot 206, such that at least one target holder portion 208 may be adjacent to each target zone 210'.

Likewise each faceplate assembly 106 may be considered a faceplate 200. In this situation, the faceplate assembly 106 may have at least one alternative target holder integrally formed therein. For example, an alternative target holder may be an integrally formed ridge, lip, post, protrusion, or the like, extending from the front surface 202 of the faceplate 200, an integrally formed slot, or the like, formed within the perimeter 212 of the faceplate 200, or an integrally formed raised edge, slit, protrusion, or the like, formed along the outer surface of the perimeter 212. Ropes, ties, rubber bands, or the like, may be used to secure a target T to the front surface 202 of the faceplate 200.

Figure 3:
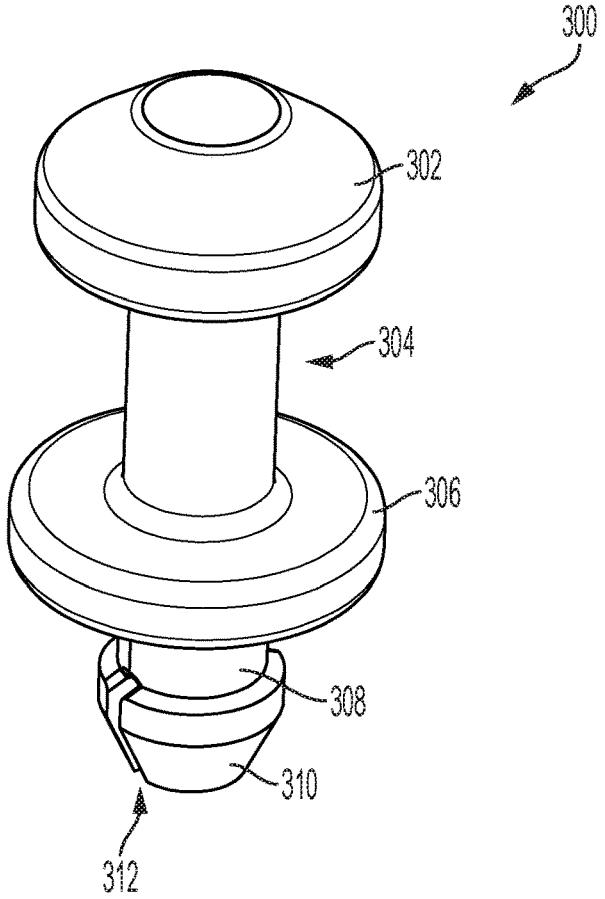
FIG. 3 illustrates an isomeric view of an example target holder.

FIG. 3 illustrates an example target holder 300 according to an embodiment. The target holder 300 may include a head 302, a shoulder 306, an enlarged end 310, a holder groove 304 between the head 302 and shoulder 306, and a shank 308 between the shoulder 306 and enlarged end 310. The enlarged end 310 may also include a slot 312 allowing the enlarged end 310 to pass through a target holder aperture 208 until the shoulder 306 presses against the front surface 202 while the enlarged head 310 presses against the rear surface 204. The target holder 300 may be made of silicone rubber having a durometer shore value A80 and able to withstand massive deformation when struck by a projectile.

Figure 5A:
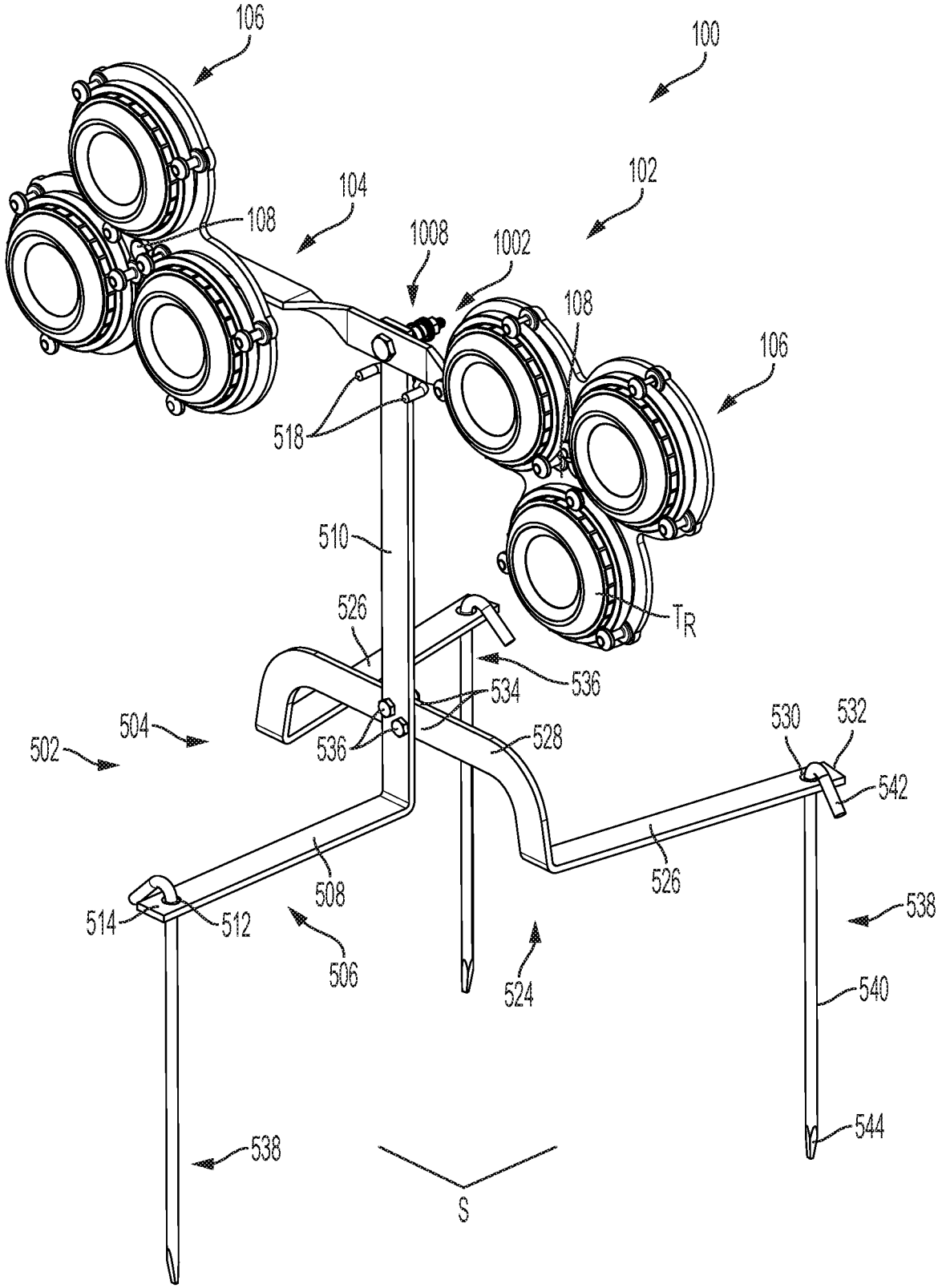
FIG. 5A illustrates an example dueling target shooting assembly with targets.
Figure 5B:
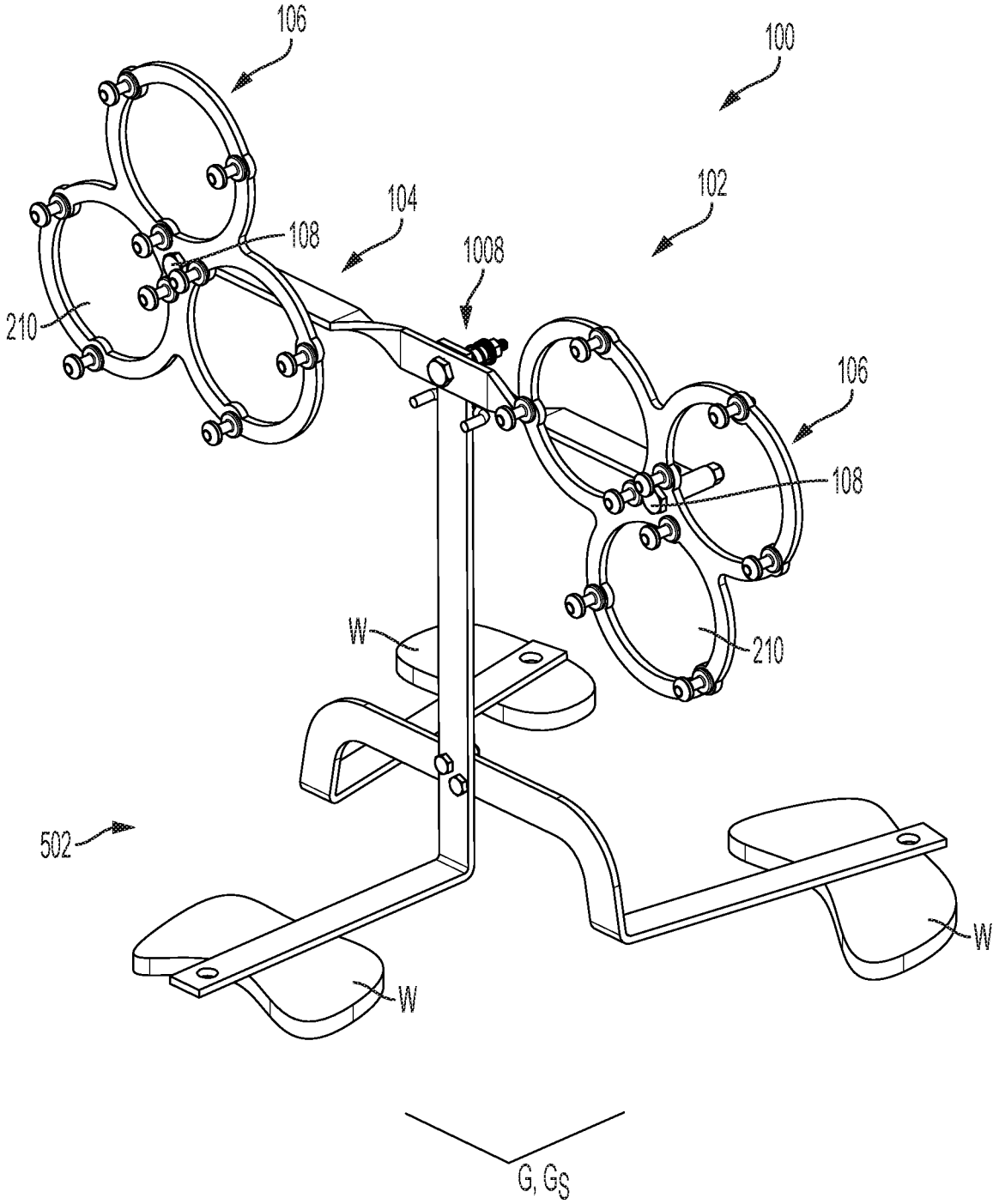
FIG. 5B illustrates an example dueling target shooting assembly without targets.
Figure 6:
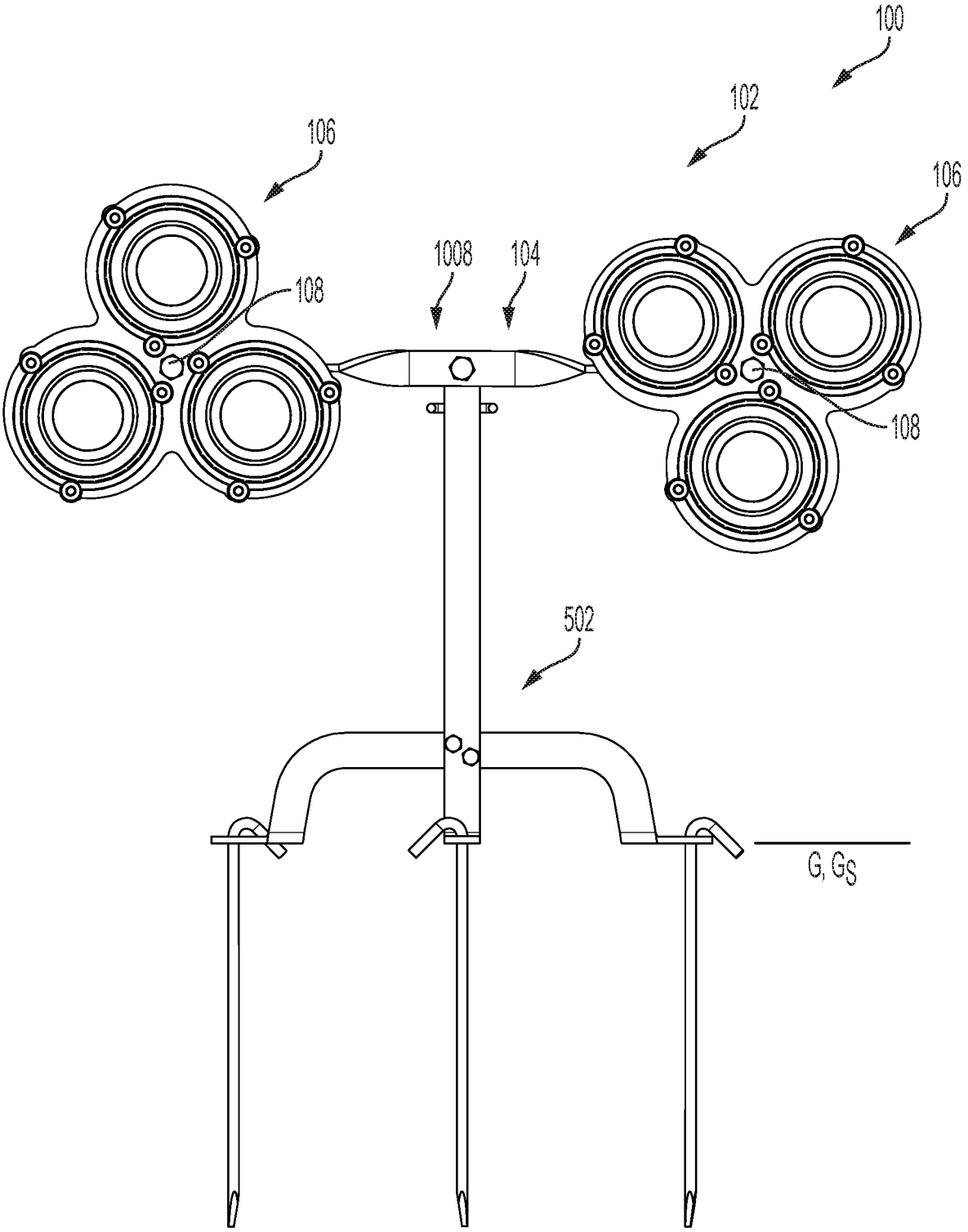
FIG. 6 illustrates a front view of an example dueling target shooting assembly.
Figure 7:
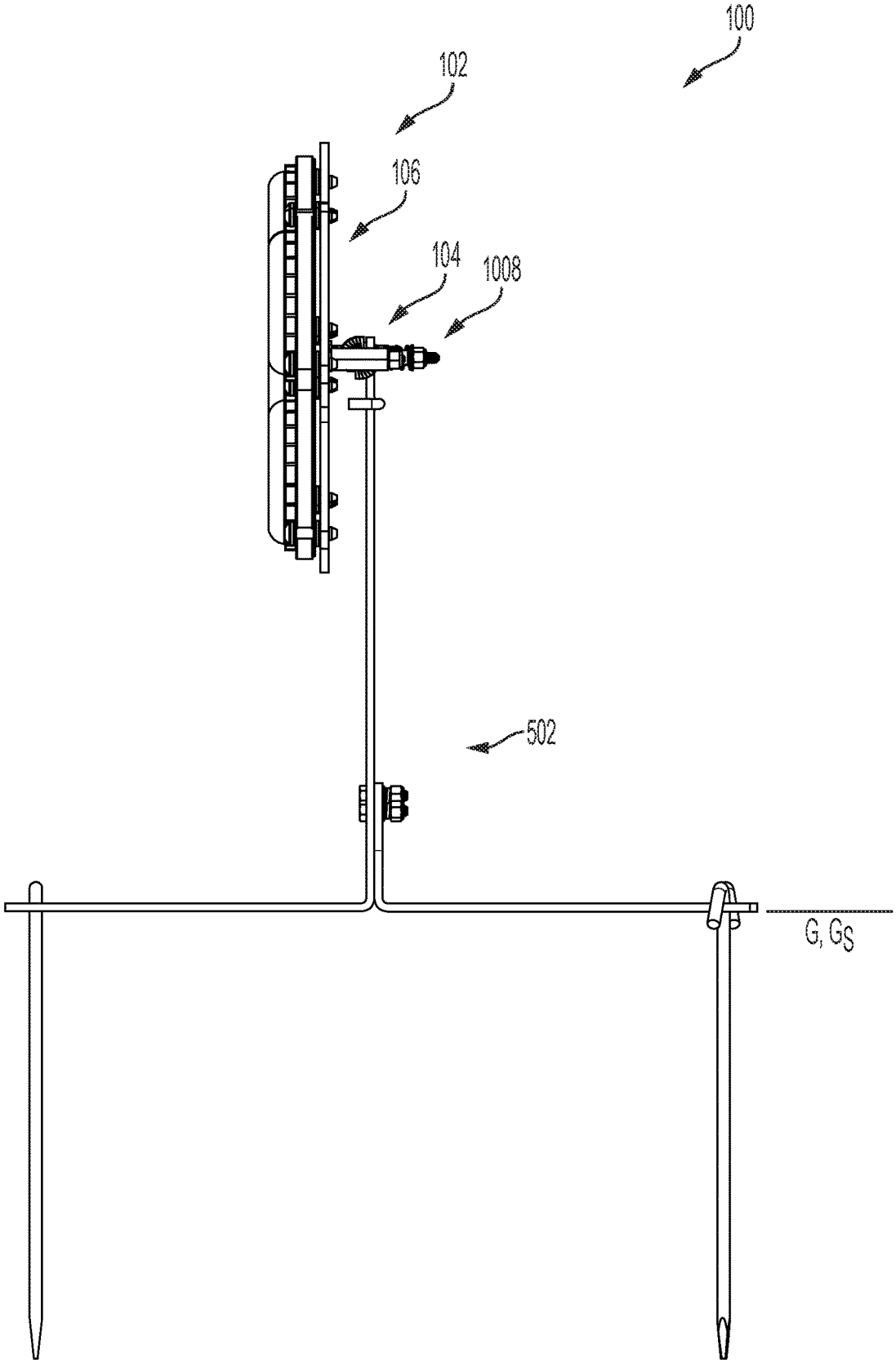
FIG. 7 illustrates a side view of an example dueling target shooting assembly.
Figure 8:
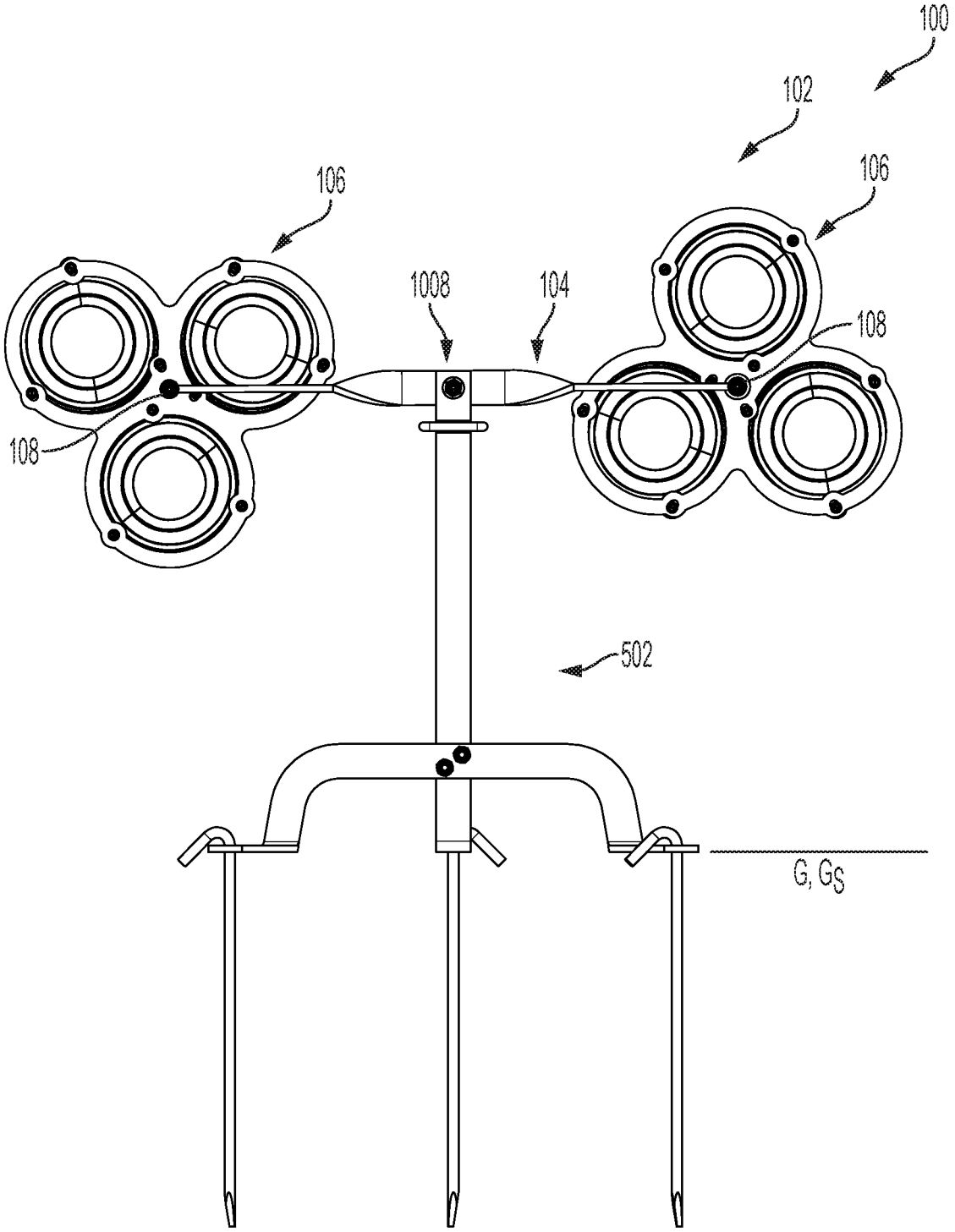
FIG. 8 illustrates a back view of an example dueling target shooting assembly.
Figure 9:
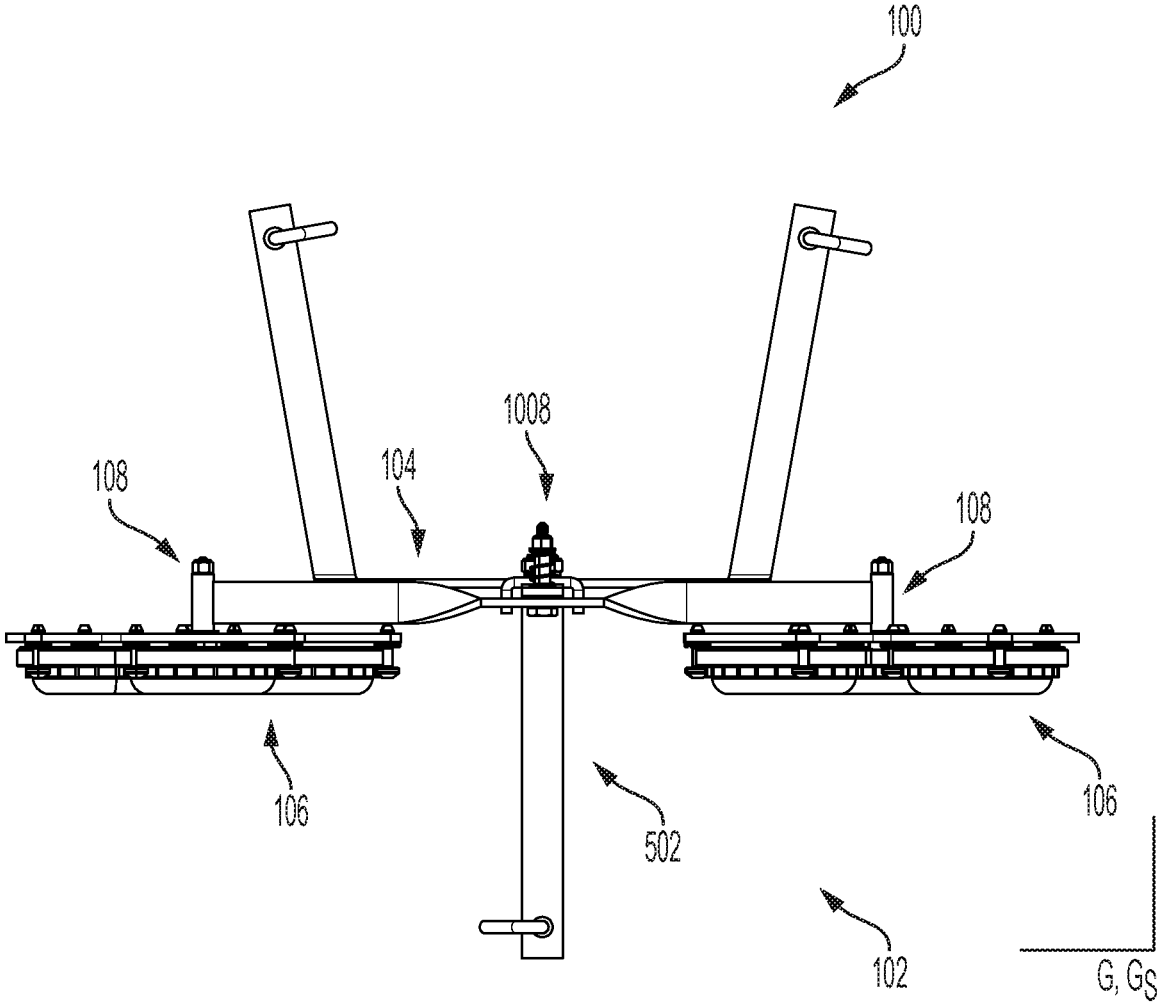
FIG. 9 illustrates a top view of an example dueling target shooting assembly.

As previously discussed additional targets T may be used with the dueling target assembly 102. For example, as seen in FIG. 1, a target T may be secured to the front surface 202 of the faceplate 200 by placing an edge of the target T within the holder groove 304 of the target holder 300. At least one target holder 300 may be used to secure the target T against the front surface 202. Using multiple target holders 300 to secure a target T to the front surface 202 will provide a more secure attachment. FIG. 5B illustrates a view of a dueling target assembly 102 without targets T, according to an embodiment. FIG. 5B illustrates an embodiment where three target holders 300 are located adjacent to each target aperture 210. Each target T secured to the front surface 202 may cover at least a portion of a target aperture 210. A target T may break free from the holder groove 304 of the target holder 300 when shot by a projectile.

Figure 4:
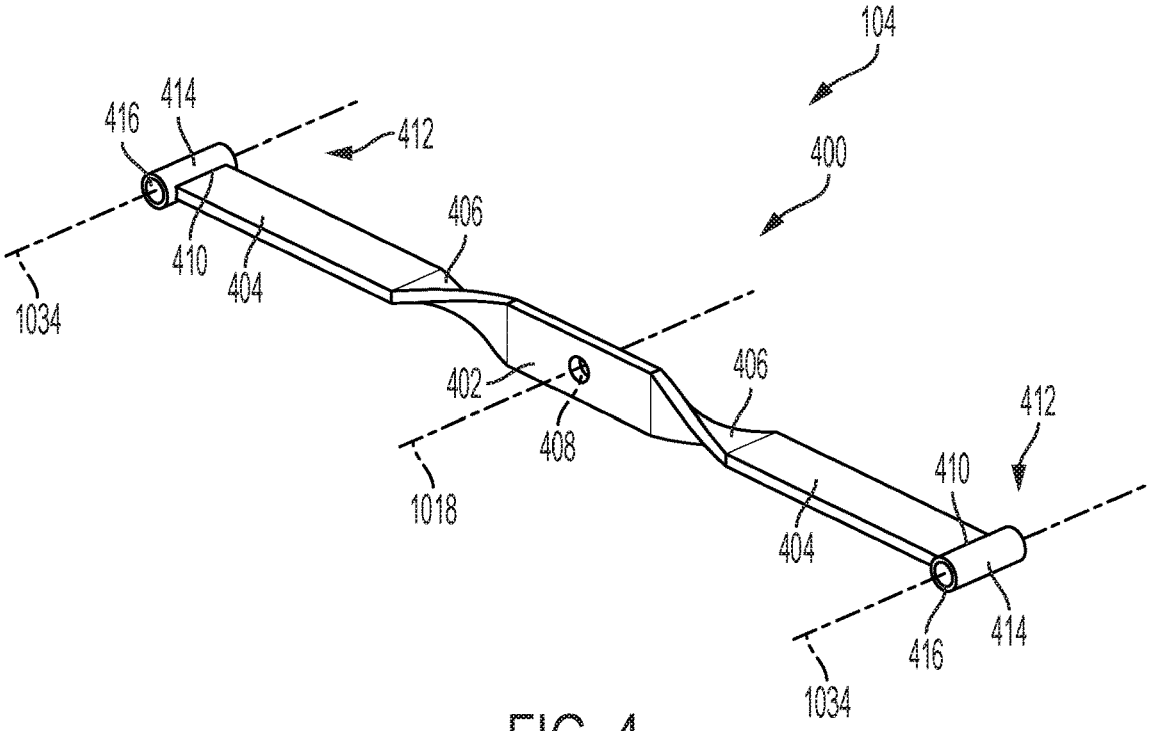
FIG. 4 illustrates an isomeric view of an example balance bar.

FIG. 4 illustrates a view of an example balance bar 104 according to an embodiment. A balance bar 104 may include an elongated portion 400, such as a bar, a shaft, a rod, or the like, with two faceplate pivot supports 412 at either end of the elongated portion 400.

The elongated portion 400 may include a center portion 402 and two end portions 404. The elongated portion 400 may be substantially flat. Alternatively, the elongated portion 400 may include two bends 406 transitioning the center portion 402 into each end portion 404 as illustrated by FIG. 5A. For example, the center portion 402 may be perpendicular to the end portions 404. A central pivot 408 may be located in the center portion 402. The central pivot 408 may be an aperture as illustrated in FIG. 4. Alternatively, the central pivot 408 may be a rearward extending post or the like. Each end portion 404 may include an outer edge 410.

Each faceplate pivot support 412 may include a pivot collar 414 and at least one bearing 416. The bearing 416 may be positioned within the pivot collar 414 or it may be positioned adjacent to the pivot collar 414. Multiple bearings 416 may be used with the pivot collar 414 in various embodiments. A pivot collar 414 may be connected to an outer edge 410 of the elongated portion 400 by any suitable connection such, for example, as an interference fit between a slot on the exterior of the pivot collar 414 that is aligned with the outer edge 410, fasteners through a plate extension of the pivot collar 414, welding, and/or the like. The balance bar 104 may be a metal plate made from, for example, AR500 steel and able to withstand massive deformation when struck by a projectile.

FIG. 5A illustrates an example dueling target shooting assembly 100 according to an embodiment. A dueling target shooting assembly 100 may include a base assembly 502, a balance bar pivot assembly 1008, a balance bar 104, two target faceplate assemblies 106, and two faceplate pivot assemblies 108. Targets T may also be used with the dueling target shooting assembly 100. FIG. 5B illustrates an example dueling target shooting assembly 100 without targets T according to an embodiment.

FIGS. 6-9 illustrate a front, side, back, and top view, respectively, of the dueling target shooting assembly 100 according to an embodiment in relation to a surface S.

A surface S refers to a surface on which the dueling target shooting assembly 100 may be positioned for target shooting. Examples of a surface S may include, without limitation, grass, dirt, sand, an interior surface (for example concrete, wood, or tile), an exterior surface (for example concrete, wood, tile, or a firing range target platform), an elevated surface (for example a table, bench, or raised platform), and/or the like.

As seen in FIG. 5A, a base assembly 502 may include a base support 504 and a balance bar pivot support 1002.

Figure 10:
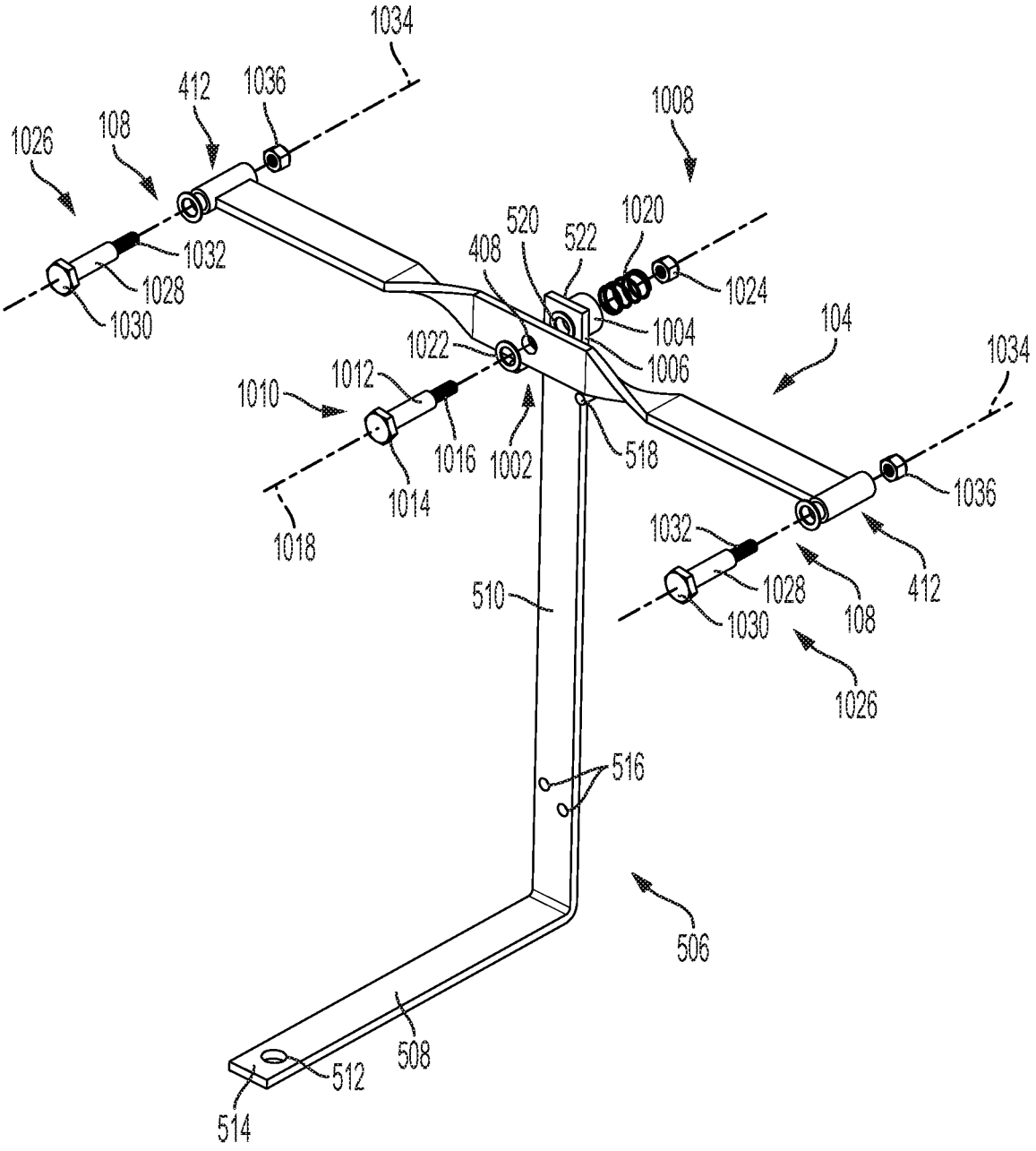
FIG. 10 illustrates an exploded view of an example balance bar pivot assembly.

The base support 504 may include an L-shaped base bracket 506 and a U-shaped base bracket 524. The L-shaped base bracket 506 may by a bent metal plate having a base leg 508 and an upright support 510. The base leg 508 may include an aperture 512 at one end 514. As seen in FIGS. 5A and 10, the upright support 510 may include at least one fastener aperture 516, a stop 518, and a pivot aperture 520 at another end 522. The stop 518 may prevent the balance bar 104 from rotating beyond a desired angle as will be described below in more detail. The U-shaped base bracket 524 may be a bent metal plate having two base legs 526 and a center portion 528. Each base leg 526 may include an aperture 530 at one end 532. The center portion 528 may include at least one fastener aperture 534. The L-shaped base bracket 506 may be connected to the U-shaped base bracket 524 via at least one base fastener 536 passing through the fastener apertures 516 and 534, for example.

The base support 504 may be utilized with at least one leg 538. For example, each base bracket 506, 524 may be secured to the surface S by a leg 538. The leg 538 may include an elongated shank 540 with an upper bent end 542 and a lower pointed end 544. The leg 538 may be any rigid material, such as, for example metal, rigid plastic, or the like. The leg 538 may me pressed through the apertures 512, 530 in the ends 514, 532 of the base brackets 506, 524, respectively.

The base support 504 may also be utilized without legs 538. For example, base support 504 may be secured to the surface S by a fixed anchor. Likewise, temporary weights W, such as heavy metal plates, concrete blocks, filled sandbags, and/or the like may be used to secure the base support 504. FIG. 5B illustrates an example dueling target shooting assembly 100 employing temporary weights W according to an embodiment. Placing the legs 538, fixed anchors, and/or weights W further away from the center of the dueling target shooting assembly 100 may provide greater stability when the dueling target shooting assembly 100 is hit by projectiles.

FIG. 10 illustrates an exploded view of an example balance bar pivot support 1002, balance bar pivot assembly 1008, and balance bar 104 according to an embodiment. The balance bar pivot support 1002 may include a pivot collar 1004 and at least one bearing 1006. The bearing 1006 may be positioned within the pivot collar 1004 or it may be positioned adjacent to the pivot collar 1004. Multiple bearings 1006 may be used with the pivot collar 1004 according to various embodiments. The pivot collar 1004 may be connected to the upright support 510 adjacent the pivot aperture 520. The pivot collar 1004 may be connected to the upright support 510 by any suitable connection such as, for example, welding, press fitting, and/or the like.

The pivot assembly 1008 of the balance bar 104 may include a pivot pin 1010, a resilient member 1020, at least one spacer 1022, and a pivot fastener 1024.

The pivot pin 1010 of the balance bar 104 may pass through the pivot support 1002 of the base assembly 502 and may be engaged in the pivot support 1002 by the pivot fastener 1024. The pivot pin 1010 may be a threaded bolt, such as a shoulder bolt, or it may be an unthreaded pin, such as an L-bolt, J-bolt, hook bolt, or the like. The pivot pin 1010 may have an elongated body 1012 with a head 1014 at one end and either threads 1016 or an aperture at the other end. The elongated axis of the pivot pin 1010 may define a pivot assembly rotation axis 1018.

The elongated body 1012 of the pivot pin 1010 may pass through the central pivot aperture 408 of the balance bar 104 such that the head 1014 of the pivot pin 1010 may hold the balance bar 104 rotatably connected to the pivot support 1002 of the base assembly 502. The balance bar 104 may be supported by the pivot support 1002 and may be pivotable about the pivot assembly rotation axis 1018.

The resilient member 1020 may be a spring member, such as a compression spring or a set of Bellville springs. The resilient member 1020 may be fabricated from a soft material such as, for example, rubber. If the pivot pin 1010 is a threaded bolt, then the compressive forces of a compression spring 1020 may be adjusted by tightening the pivot fastener 1024 on the threaded end 1016 of the pivot pin 1010. If the pivot pin 1010 is an unthreaded pin, then Belleville springs may be added or removed between the pivot collar 1004 and the pivot fastener 1024. By adjusting the distance between the pivot collar 1004 and the pivot fastener 1024, the resilient spring force may be changed and the resistance in rotation of the balance bar 104 may be changed.

The spacer 1022 may be a flat washer, a rigid plastic cylinder, or the like. The spacer 1022 may be placed between the head 1014 of the pivot pin 1010 and the balance bar 104, between the balance bar 104 and the upright support 510 of the base support 504, between the pivot collar 1004 of the pivot support 1002 and the resilient member 1020, and/or between the resilient member 1020 and the pivot fastener 1024. Multiple spacers 1022 may be used at any or all of these locations.

The pivot fastener 1024 of the balance bar 104 may be a threaded locking fastener, such as a nut and lock washer combination or a Nylon locking nut. Likewise, the pivot fastener 1024 may be unthreaded fastener, such as a pin (spring pin, split pin, cotter pin, hairpin, R-clip, or the like) which passes through an aperture near the end of a pin. The use of an unthreaded pivot fastener 1024 allows for quick disconnection of the pivot fastener 1024 from the pivot pin 1010 without the use of tools. This allows a user to quickly disassembly the dueling target shooting assembly 100.

As seen in FIG. 10, each of the two pivot assemblies 108 may include a pivot pin 1026 and a pivot fastener 1036.

Similar to the pivot assembly 1008 of the balance bar 104 described above, the pivot pin 1026 for each of the two pivot assemblies 1008 may be a threaded bolt, such as a shoulder bolt, or it may be an unthreaded pin. The pivot pin 1026 may have an elongated body 1028 with a head 1030 at one end and either threads 1032 or an aperture at the other end. The elongated axis of the pivot pin 1026 defines a pivot assembly rotation axis 1034.

The pivot fastener 1036 for each of the two pivot assemblies 1008 may be a threaded locking fastener, such as a nut and lock washer combination or a Nylon locking nut. Likewise, the pivot fastener 1036 may be an unthreaded fastener, such as a pin (spring pin, split pin, cotter pin, hairpin, R-clip, or the like) which passes through an aperture near the end of a pin. The use of an unthreaded pivot fastener 1036 allows for quick disconnection of a target faceplate assembly 106 from the faceplate pivot support 412 without the use of tools. This allows a user to quickly remove and/or replace a damaged target faceplate assembly 106 from the balance bar 104.

When all of the target apertures 210 on a target faceplate assembly 106 are covered by targets T, the target faceplate assembly 106 and targets T combination is balanced on the faceplate pivot assembly 108 and supported by the faceplate pivot support 412 of the balance bar 104. The center of mass of the target faceplate assembly 106 and targets T combination is aligned with the rotation axis 1034 of the faceplate pivot assembly 108.

The dueling target assembly 102 may be rotatably balanced on a pivot assembly 1008 of the balance bar 104 and supported by a balance bar pivot support 1002 of a base assembly 502. The center of mass of the dueling target assembly 102 may be aligned with the pivot assembly rotation axis 1018 of the balance bar 104.

The combined weight of the targets T on a target faceplate assembly 106 may be greater than the weight of just the target faceplate assembly 106 itself. When one target T is impacted 106 (such as, for example, when the target is shot or otherwise hit by a projectile), the center of mass of the target faceplate assembly 106 and targets T combination is offset from the rotation axis 1034 of the faceplate pivot assembly 108. For example, the center of mass may become offset if a target is hit by a projectile, if the target is broken, if the target is removed from the faceplate assembly and/or the like.

The combined weight of the targets T on a dueling target assembly 102 may be greater than the combined weight of the balance bar 104, the two target faceplate assemblies 106, and two faceplate pivot assemblies 108. When one target T is impacted from one side of the dueling target assembly 102, the center of mass of the dueling target assembly 102 is offset from the pivot assembly rotation axis 1018 of the balance bar 104.

When one target dueling competitor successfully shoots a target T, the center of mass of the dueling target assembly 102 to offset from the pivot assembly rotation axis 1018 of the balance bar 104. For example, if the target is a clay pigeon, the target may break when shot, and the broken pieces of the clay pigeon target T may fall from the holder groove 304 of the target holder 300, thus causing the center of mass of the dueling target assembly 102 to offset from the pivot assembly rotation axis 1018 of the balance bar 104. As such, the dueling target assembly 102 rotates upward on the successful shooter's side. The balance bar 104 comes to rest against the stop 518 of the base support 504.

Likewise the center of mass of the target faceplate assembly 106 and remaining targets T combination on the successful shooter's side begins to rotate. If the target faceplate assembly 106 is well-balanced, this may include multiple complete rotations followed by many undulating pendulum swinging motions before the center of mass of the target faceplate assembly 106 and remaining targets T combination coming to rest directly below the rotation axis 1034 of the faceplate pivot assembly 108. While the target faceplate assembly 106 and remaining targets T combination is rotating to this new balanced state, the shooter has a new added difficulty of shooting the second and subsequent targets T before the target faceplate assembly 106 and remaining targets T combination comes to rest in a new balanced state or before the opponent shoots and frees a target T on his or her side, thus causing the dueling target assembly 102 to rotate in the other direction. The goal of the dueling competition is to be the first competitor to shoot all targets T on the competitor's side or to have fewer remaining targets T on competitor's side than the opponent's side when competition time or allotted ammunition runs out. Dueling competitions test a competitor's speed and ability to shoot a moving target. A timed dueling competition may further test a competitor's precision skills. A limited-ammunition dueling competition may further test a competitor's accuracy skills.

The above-disclosed features and functions, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

The invention claimed is:

1. A dueling target assembly comprising:

a balance bar comprising:

a central portion including a central pivot aperture, a first end portion, and a second end portion;

a first target faceplate comprising:

a first central pivot point, a plurality of first apertures that extend through the first target faceplate and are spaced around the first central pivot point, a plurality of first targets, wherein each of the plurality of first targets is secured to the first target faceplate with a plurality of first target holders such that each of the plurality of first targets covers at least a portion of one of the plurality of first apertures, wherein the first target faceplate is pivotally connected to the first end portion at the first central pivot point, and a second target faceplate comprising:

a second central pivot point, a plurality of second apertures that extend through the second target faceplate and are spaced around the second central pivot point, a plurality of second targets, wherein each of the plurality of second targets is secured to the second target faceplate with a plurality of second target holders such that each of the plurality of second targets covers at least a portion of one of the plurality of second apertures, wherein the second target faceplate is pivotally connected to the second end portion at the second central pivot point, wherein a center of mass of the dueling target assembly is aligned with the central pivot aperture when the first target apertures and the second target apertures are covered by targets, wherein the center of mass of the dueling target assembly is offset with the central pivot aperture when at least one of the targets is removed from either the first target faceplate or the second target faceplate.

2. The dueling target assembly of claim 1, wherein the balance bar is pivotable about the central pivot aperture.

3. The dueling target assembly of claim 1, wherein:

the first target faceplate further comprises a plurality of first target holder apertures, wherein the plurality of first target holder apertures is positioned adjacent to each of the plurality of first apertures, wherein each first target holder aperture is configured to receive one of the plurality of first target holders; and the second target faceplate further comprises a plurality of second target holder apertures, wherein each of the plurality of second apertures is positioned adjacent to a plurality of the plurality of second target holder apertures, wherein each second target holder aperture is configured to receive one of the plurality of second target holders.

4. The dueling target assembly of claim 3, wherein:

a center of mass of the first target faceplate is aligned with the first central pivot point when the plurality of first targets are secured to the first target faceplate, the center of mass of the first target faceplate is offset from the first central pivot point when at least one of the plurality of first targets is removed.

5. The dueling target assembly of claim 1, further comprising:

a base assembly comprising:

a base support, and a balance bar pivot support; and a balance bar pivot assembly having a balance bar pivot assembly rotation axis, wherein:

the balance bar pivot assembly rotation axis is configured to align with the central pivot aperture of the balance bar and the balance bar pivot support of the base assembly.

6. The dueling target assembly of claim 5, wherein the base support comprises:

at least one ground stake;

an L-shaped base bracket; and a U-shaped base bracket.

7. The dueling target assembly of claim 5, wherein:

the balance bar pivot support comprises:

a pivot collar; and at least one bearing, the at least one bearing is adjacent the pivot collar.

8. The dueling target assembly of claim 5, wherein the balance bar pivot assembly comprises:

a pivot pin; and a pivot fastener.

9. The dueling target assembly of claim 8, wherein the balance bar pivot assembly further comprises a resilient member.

* * * * *